United States Patent [19]

Moses

[11] 3,933,014

[45] Jan. 20, 1976

[54] DOOR LOCK ATTACHMENT

[76] Inventor: Adolph Moses, 8 E. 83rd St., New York, N.Y. 10028

[22] Filed: Feb. 18, 1975

[21] Appl. No.: 550,269

[52] U.S. Cl. ..... 70/416; 70/447

[51] Int. Cl.[2] ..... E05B 13/00

[58] Field of Search ..... 70/416, 419, 429, 430, 70/431, 447, DIG. 58

[56] References Cited

UNITED STATES PATENTS

| | | | |
|---|---|---|---|
| 1,705,667 | 3/1929 | Heath | 70/430 |
| 2,463,195 | 3/1949 | Mungan | 70/416 |
| 3,585,827 | 6/1971 | Dominguez | 70/416 |
| 3,862,556 | 1/1975 | Moses | 70/416 |

*Primary Examiner*—Robert L. Wolfe

[57] ABSTRACT

A cheap, one piece, pocketable, one hand operated, snap on or off clamping attachment for a lock bolt thumb knob for preventing the lock from being opened from the outside. One end of the attachment has connected elements that can embrace the thumb knob in either its vertical or horizontal position. The connected elements have two extended legs that spring grip the door knob hub and can bias the attachment to its operative position or hold it in its inoperative position. This cheap device takes the place of a more expensive bolt and its installation cost.

11 Claims, 9 Drawing Figures

DOOR LOCK ATTACHMENT

The present invention is an improvement on my U.S. Pat. No. 3,862,556 in that it can be used on other than anchor shaped thumb knobs, on vertically oriented thumb knobs, is more convenient to handle, and leaves the thumb knob more easily accessible when left on the lock in the inoperative position.

This invention relates to a pocketable, one hand operated snap on or off clamping attachment to a lock bolt thumb knob to prevent the lock from being opened from the outside by the use of its own key, a pass key, or by lock picking devices. One size attachment will suffice for a range of thumb knob shapes and dimensions and for a range of thumb knob to door knob center distance.

Many entrance-way doors to homes, apartments or motels are fitted with door locks which include a thumb knob actuated bolt so that the room occupant may bolt or unbolt the door by turning the thumb knob through a quarter of a revolution. However, when the bolt is in its operative position, a person using a key, pass key, a picking device or cylinder wrench may unbolt the door from the outside. But if the thumb knob is restrained from rotating, it is impossible from the outside for the bolt to be returned to its inoperative position unless the lock mechanism is broken. In that event, there will be evidence of forcible entry, providing grounds for collecting any burglary insurance that might be in force.

A properly installed lock will have the thumb knob in the horizontal position when the bolt is extended. Home occupants who find the thumb knob in a vertical position when the bolt is extended may easily correct this by removing the two small screws that attach the thumb knob plate 17 to the door, pulling out the thumb knob 15, giving it a quarter turn to the horizontal position, re-engaging it with the lock, and replacing the two screws.

The two lobed embodiment of this invention is applicable only to installations where the thumb knob is horizontal when the bolt is engaged. The two lobed embodiment is preferred for home or apartment dwellers since it can conveniently be left on the lock when the attachment is in the inoperative position even when the thumb knob is located below the door knob.

The three lobed embodiment of this invention is designed for those who find themselves in motels with improperly oriented thumb knobs and cannot or do not want to have the thumb knob re-oriented. Since the motel occupant should not leave the attachment on the lock when he is not in, the bends that form the detent for holding the attachment in its inoperative position on the lock are omitted.

It is therefore an object of the present invention to provide a simple, one piece, one hand operated, pocketable attachment that can be snapped on a lock to an operative position, shifted and snapped to an inoperative position on the lock, or snapped off the lock and carried in a pocket or pocket book. The attachment requires no skill to operate and does not mar the door or door frame. It will function on thumb knobs of many configurations and on a range of lock dimensions. It automatically is secured in its operative position.

It is to be understood that the drawing is designed for the purpose of illustration only and not as a definition of the limits of the invention.

In the drawing, wherein similar reference characters denote similar elements throughout the several views.

Figures 1, 2, 3, 4, 5, 6, 7, 8, 9:
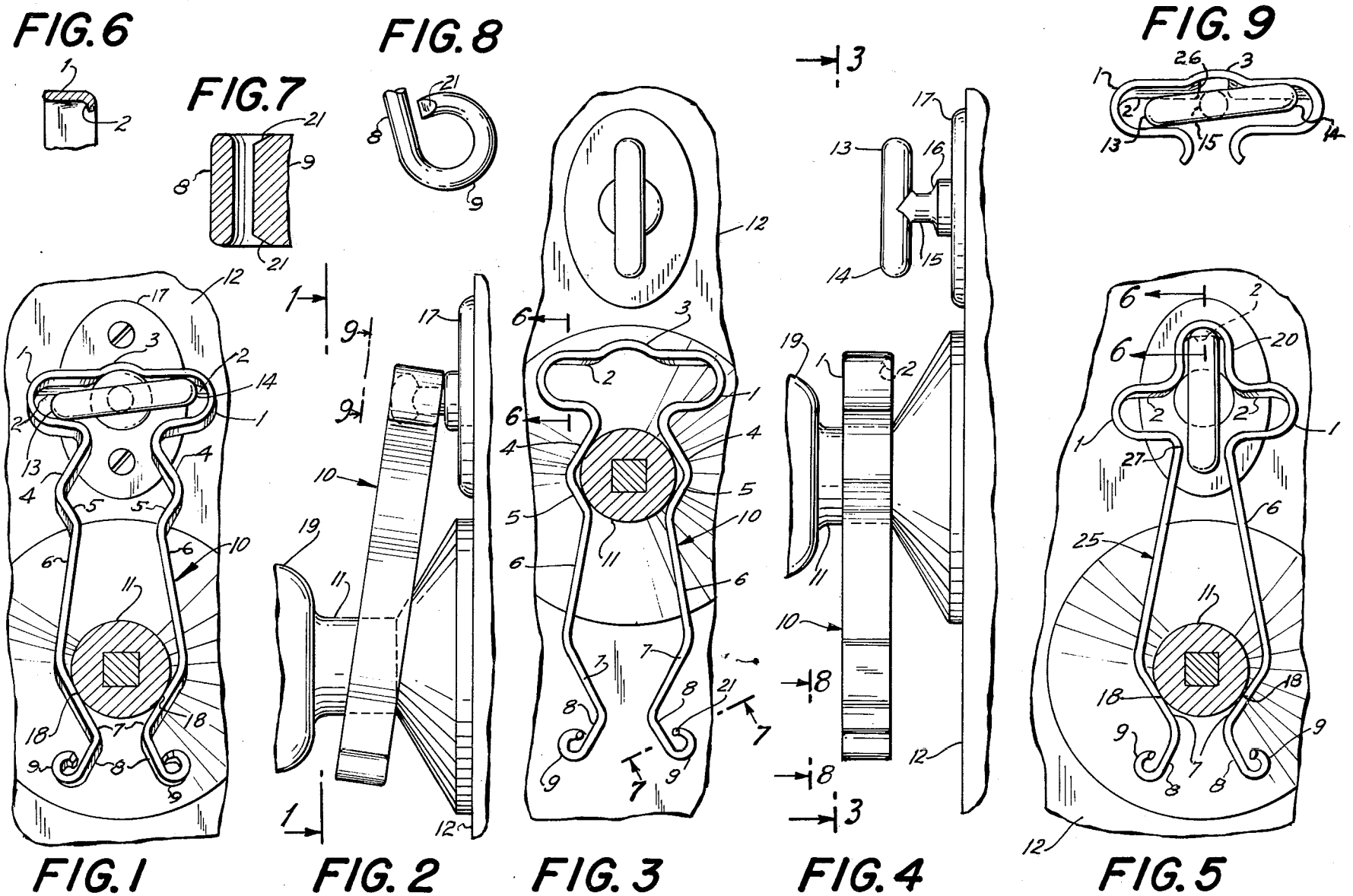
FIG. 1 is an elevation or inside view of a door in which a bolt type mortise lock has been installed and the locking attachment 10 is shown in its operative position.
FIG. 2 is a side view of FIG. 1.
FIG. 3 is a view similar to FIG. 1 except that the attachment 10 is in its inoperative position.
FIG. 4 is a side view of FIG. 3.
FIG. 5 is an inside view of a door with a modified embodiment 25 of the invention for use on installations where the thumb knob has been improperly installed in its vertical position when the bolt is engaged and the attachment 25 is not to be left in its inoperative position on the lock.
FIG. 6 is a cross sectional view taken along section line 6—6 of FIG. 3 & FIG. 5.
FIG. 7 is an enlarged cross sectional view taken on line 7—7 on FIG. 3. It shows the ends of the eyes that were chamfered when the strip was cut off, thus avoiding a separate chamfering operation.
FIG. 8 is an enlarged view taken on line 8—8 on FIG. 4.
FIG. 9 is a view taken at line 9—9 on FIG. 2 but with modified lips 2.

The attachment is preferably made of steel strip having rounded edges. It can be most economically produced by a four slide machine and/or a punch press. Note that if, as intended, the attachment is made in one piece, there will be no assembly operation.

I shall first describe the embodiment shown in FIGS. 1, 2, 3, 4 and 6. There are two connected U shaped sections 1, laid on their side. The door side of the horizontal top leg of each U1 section is bent downward to form a slight lip 2. The top legs of the two U1 sections are joined by a section 3 that is slightly arched upward. The bottom legs of the U1s are extended to provide sections 4, which slant outward from the line of symmetry, then continued to sections 5, which slant inward, then continued by sections 6, which slant outward slightly to sections 7, which slant inward. Still continuing downward are sections 8, which flare outward and are terminated by being bent further outward to form eyes 9.

Referring to FIG. 1, the attachment 10 has been pushed down on the door knob hub 11, the sections 8 spreading the legs 6 until sections 7 grip the door knob hub 11, biasing the attachment 10 downward. Then the attachment 10 is pulled upward and the U1 sections pushed towards the door 12 so that they embrace the thumb knob wings 13 and 14. The arched section 3 clears the thumb knob shaft 15 which sometimes is above the thumb knob wings 13 and 14, either because it is thicker or because the thumb knob shaft 15 has been improperly installed, causing it to slant downward, or because there is a large fillet 16. The attachment 10 is then biased downward by the reaction of the door knob hub 11 at its contact points 18 with sections 7. There is always considerable rotary play of the thumb knob shaft 15, which allows both wings 13 and 14 to be contacted by the two U1s and their lips 2.

Any attempt from the outside to retract the lock bolt will cause the thumb knob shaft 15 to rotate slightly until one of the wings 13 swings away from a leg of a U1 and its lip 2 until it contacts the opposite leg of the U1. There will have been only a slight retraction of the bolt. Any further bolt retraction will be prevented by the reaction of the door knob hub 11 at point 18 against section 7 which prevents further rotation of the thumb knob shaft 15 and the attachment 10. Note that this reaction, due to torque, has a downward component which biases the attachment 10 more firmly onto the wing 14 in contact with lip 2. The horizontal component of the reaction force on section 7 is balanced by the reaction of the thumb knob wing 14 against the U1 section in FIG. 1 or against the U20 section in FIG. 5, or by the reaction of the thumb knob shaft 15 against a lip end 26 in FIG. 9.

Referring to FIG. 1, the attachment may be placed in its inoperative position by lifting it slightly or until the lips 2 clear the wings 13 and 14 or until the bottom legs of the U1s contact the wings 13 and 14, then pulled outward until it clears the wings 13 and 14 and finally pushed downward until the sections 4 rest on the door knob hub 11 as shown in FIG. 3. Leaving the attachment free will then allow the spring action of the legs 6 to bring sections 5 into contact with the door knob hub 11. In this position, the center of gravity of the attachment 10 being below the door knob hub 11 axis, the attachment 10 will hang in a vertical position. It will also be restrained from swinging, or sliding towards the door 12 or door knob 19. Also on lock installations where the thumb knob shaft 15 is below the door knob 19, the attachment 10 will be prevented from dropping down and contacting the thumb knob wings 13 and 14.

The attachment 10 can be removed entirely by pulling it outward and upward until the eyes 9 clear the door knob 19.

The embodiment shown in FIG. 5 is intended for people such as travelers or salesmen who do not intend to leave the attachment in its inoperative position on the lock. The sections 4 and 5 could be included but were omitted to lower the manufacturing cost. It operates in the same way as the embodiment shown in FIG. 1, with the exceptions that it has no sections 4 and 5 for holding the attachment in an inoperative position on the lock and that the slightly arched section 3 has been replaced by an inverted U section 20 which together with the lower leg extensions 27 of the horizontal U1 sections embrace the thumb knob wings 13 and 14 if they lie in a vertical plane when the bolt is extended.

The strip from which the attachment is formed should have rounded edges, and a smooth, polished surface to minimize any tendency for the attachment to scratch or mar the lock surfaces or the door surface if it accidentally contacts the latter. Any possibility of the marring of surfaces by the attachment would be reduced or eliminated by coating the attachment with a non-abrasive such as catalyzed urethane resin, or any one of the plastics used for bearings.

What is claimed is:

1. A one-hand operated, snap on and off, pocketable security locking attachment for a door lock having a thumb knob actuated bolt and a door knob hub, a single piece of material formed to embrace loosely the upper, lower, and lateral surfaces of the thumb knob, having shallow lips engaging the rear surfaces of the thumb knob but otherwise the embracing elements are open, both front and rear, and the thumb knob embracing elements extended to embrace the door knob hub.

2. The attachment as recited in claim 1, wherein the thumb knob embracing section consists of horizontal U shaped portions, the upper legs of which are joined by an arched or inverted U section and the door knob hub embracing section consists of downward extensions of the lower legs of the horizontal U sections.

3. The attachment as recited in claim 2, wherein the upper portions of the door knob hub embracing section are spaced to embrace loosely a thumb knob wing lying in a vertical plane.

4. The attachment as recited in claim 2, wherein the door knob hub embracing sections have angularly opposed sections, spring gripping it both above and below its axis when the thumb knob embracing sections are disengaged from the thumb knob.

5. The attachment as recited in claim 2, wherein the door knob hub embracing section has opposed angular sections spring gripping it below its axis when the thumb knob embracing sections are engaged with the thumb knob.

6. The attachment as recited in claim 5, wherein the door knob hub gripping sections are extended and the extensions are spread outward from the attachment's axis of symmetry.

7. The attachment as recited in claim 6, wherein the outward spread sections are terminated in eyes.

8. The attachment as recited in claim 1, wherein the attachment is formed from strip having slightly rounded or chamfered edges.

9. The attachment as recited in claim 7, wherein the ends of the eyes are preferably during cut off chamfered by an amount approximately equal to the radius of the rounded edges of the attachment material.

10. The attachment as recited in claim 1, wherein the shallow lips have inner lateral ends spaced to embrace loosely the thumb knob shaft.

11. The attachment as recited in claim 1, with a coating having non-abrasive properties, such as catalyzed urethane resin.

* * * * *